US006691866B1

(12) United States Patent
Klock

(10) Patent No.: US 6,691,866 B1
(45) Date of Patent: Feb. 17, 2004

(54) BOTTLE POCKET FOR GOLF BAGS

(75) Inventor: Paul Klock, Rochester, NY (US)

(73) Assignee: Izzo Golf Inc., Macedon, NY (US)

( * ) Notice: Subject to any disclaimer, the term of this patent is extended or adjusted under 35 U.S.C. 154(b) by 0 days.

(21) Appl. No.: 10/210,960

(22) Filed: Aug. 2, 2002

(51) Int. Cl.[7] ..... A63B 55/00

(52) U.S. Cl. ..... 206/315.5; 206/315.3; 224/274

(58) Field of Search ..... 206/315.3, 315.5; 224/274, 148.4

(56) References Cited

U.S. PATENT DOCUMENTS

| | | | | | |
|---|---|---|---|---|---|
| 2,521,573 | A | * | 9/1950 | Filler et al. | 206/315.5 |
| 2,853,111 | A | * | 9/1958 | Willaims | 206/315.5 |
| 5,096,059 | A | * | 3/1992 | Henderson | 206/315.5 |
| 5,176,253 | A | * | 1/1993 | Perrin et al. | 206/315.5 |
| 5,222,598 | A | * | 6/1993 | Yamazoe | 206/315.5 |
| 5,402,883 | A | * | 4/1995 | Shin | 206/315.5 X |
| 5,634,557 | A | * | 6/1997 | Shin et al. | 206/315.5 X |
| 5,640,855 | A | * | 6/1997 | Crescenzo et al. | 206/315.3 X |
| 5,722,253 | A | * | 3/1998 | Todd | 206/315.5 X |
| 5,722,574 | A | * | 3/1998 | Pratt | 224/148.4 |
| 5,927,581 | A | * | 7/1999 | Reddy et al. | 224/578 |
| 6,067,813 | A | * | 5/2000 | Smith | 62/371 |
| 6,283,260 | B1 | * | 9/2001 | Yasuda, Sr. | 190/102 |
| 6,375,004 | B1 | * | 4/2002 | Tuerschmann et al. | 206/315.5 X |

* cited by examiner

*Primary Examiner*—Sue A. Weaver
(74) *Attorney, Agent, or Firm*—Neal L. Slifkin; Harris Beach LLP

(57) ABSTRACT

A golf bag is provided with a dual strap carrying device designed so that the golf bag may be suspended from both shoulders. The golf bag is oriented transversely across the back of the wearer and includes a liquid refreshment pocket for holding a bottle in an upright position accessible to the hand of the wearer. For example, when worn by a right handed user, the bottle pocket, which is on top of or near the ball pocket is easily accessible to the wearer's left hand. The bottle will be held in an upright position adjacent the wearer's left side for right handed golfers, and may be reached by the left hand without difficulty. The bottle pocket is configured to tightly hold the bottle against the bag, such that the bottle is in an upright position when the bag is worn across the back. The bottle pocket could include vent holes for draining any condensation or other liquid which collects in the bottle pocket. The bottle pocket is sized to fit standard size bottles.

12 Claims, 1 Drawing Sheet

BOTTLE POCKET FOR GOLF BAGS

FIELD OF INVENTION

The present invention relates to golf bags and, more particularly, to apparatus used in conjunction with golf bags to allow for convenient access to a water bottle or other liquid refreshment stored in the golf bag.

BACKGROUND OF THE INVENTION

The game of golf is one of the most widely enjoyed sports activities in the world. The number of persons participating in this activity, both at the professional and recreational level, is almost unparalleled. Not only is this activity already widespread, but also the ranks of golfers continue to swell.

The sport of golf is typically played on a course consisting of nine or eighteen holes. A set of clubs is used to strike a golf ball along each hole comprising the course. Each hole consists of a tee box which defines a starting location wherein a golfer places a ball and initially strikes the ball towards a green. Each green includes a recessed cup, and it is the object of the golfer to strike the ball with a series of strokes into the cup. Different clubs are used to vary the height, distance and spin of the ball. The holes normally vary in length from short holes of approximately one hundred yards to longer holes of five hundred yards and greater. The holes are flanked by rough areas out of which it is more difficult to play, and hazards are provided to increase the intricacy and precision required in play.

Golfers may travel over a course during play in a variety of manners. For example, a golfer may walk a course and carry his/her clubs or sometimes employs another to carry clubs for him/her. Other golfers employ wheeled pull carts which receive a set of clubs so that a golfer may push or pull the cart as the golfer walks each hole. Motorized or engine driven carts are available at some courses and, in fact, are required for play at certain courses. Here, a golfer mounts his/her clubs on the motorized cart and drives across the course from ball lie to ball lie.

The present invention concerns those persons who walk a golf course and carry their own golf bag and clubs. The typical golf bag which receives the set of clubs is in the form of a tubular carrying member closed at one end so that the shafts of the clubs may be longitudinally received in the bag. One or two straps are connected to the golf bag. The golfer or the caddy then carries such bag by inserting his arms through the straps so that the straps extend across the shoulders, thus supporting the bag for travel. A small handle may also be mounted on the bag, normally between the end points of the strap, to enable the bag to be carried by the human hand.

A double strap carrying system is preferable to a single strap because with a single strap, the entire weight of the golf clubs and bag, which may typically be on the order of twenty to twenty-eight pounds, strains the muscles of the neck and shoulders unduly and further causes muscular strain resulting from the imbalanced nature of this method of carriage. Indeed, the imbalance can cause associated muscle soreness in the hips and lower back due to the fact that the center of gravity of the bag is offset with respect to the spine. This is of particular concern to those golfers who experience back problems.

A carrying system has been developed that can be manufactured both by original equipment on a golf bag and which can be retrofitted onto standard golf bags. This carriage system is simple to use and enhances the game of golf for those who normally carry their golf bags. U.S. Pat. Nos. 5,038,984, 5,042,703 and 5,042,704, all issued to Izzo, the disclosures of which are incorporated by reference herein, relate to this golf bag carrying system. The system allows the user to comfortably carry the golf bag such that it is centered on the back of the wearer and so that the weight of the golf bag is equally distributed between both shoulders of the wearer. The present invention is designed to be used with this and other golf bag carrying systems.

SUMMARY OF THE INVENTION

According to the present invention, a golf bag is preferably provided with a dual strap carrying device. The carrying system is designed so that the golf bag may be suspended from and supported by both shoulders in a fully supported state. In the fully supported state, therefore, the golf bag is oriented transversely across the back of the wearer. However, the present invention is suitable for use on any golf bag.

Generally, the golf bag is in the form of an elongated tubular body having a surrounding sidewall, a closed end and an open end so that set of golf clubs may be inserted in the golf bag for storage and transport. Auxiliary compartments are provided to permit transport of auxiliary golf equipment and are oriented to permit balancing of the weight of the golf bag and clubs.

When golfing in warm weather, it is desirable to have water or other liquid refreshment available to drink. Many golf bags incorporate bottle pockets for holding water bottles or other bottles for liquids. In the past, these bottle pockets have not been easily accessible to the wearer. The present invention provides for a bottle pocket which holds the bottle upright and is easily accessible to the wearer. When the golf bag is worn across the back, the longitudinal axis of the golf bag is generally horizontal, or offset from the horizontal by a small angle, such as ten degrees. In this position, the bottle pocket of the present invention is easily accessible to one of the wearer's hands. For example, when worn by a right handed user, the bottle pocket, which is on top of or near the ball pocket, is easily accessible to the wearer's left hand. The bottle will be held in an upright position adjacent the wearer's left side for right handed golfers, and may be reached by the left hand without difficulty.

The bottle pocket is configured to tightly hold the bottle against the bag, such that the bottle is in an upright position when the bag is worn across the back. The bottle pocket could include vent holes for draining any condensation or other liquid which collects in the bottle pocket. The bottle pocket is sized to fit standard size water bottles or soft drink bottles of, for example, twelve ounces, sixteen ounces, one liter or other similarly sized bottles.

The bottle pocket has an opening designed to receive the bottle and hold the bottle securely within the pocket. Depending on the size of the bottle, some bottles may be completely within the pocket and other bottles may project out of the pocket. However, in all cases, the bottle will be held in a generally vertical orientation when the golf bag is in a generally horizontal orientation. This orientation minimizes the chance of a spill of the liquid if the cap of the bottle is not securely tightened and facilitates the easy removal of the bottle by the golfer.

Preferably, the bottle pocket is constructed from the same material as the ball pocket and the golf bag, but the bottle pocket could be made from any suitable material such as canvas, cotton, nylon, leather, polyester, or the like.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is used in connection with a golf bag that uses a strap assembly enabling a golfer to conveniently carry a golf bag on both shoulders. These straps may be mounted over the left and right shoulders of a person who is to carry the golf bag so that the weight of the golf bag is suspended from both of the person's shoulders to hang in an orientation across the person's back.

Figure 1:
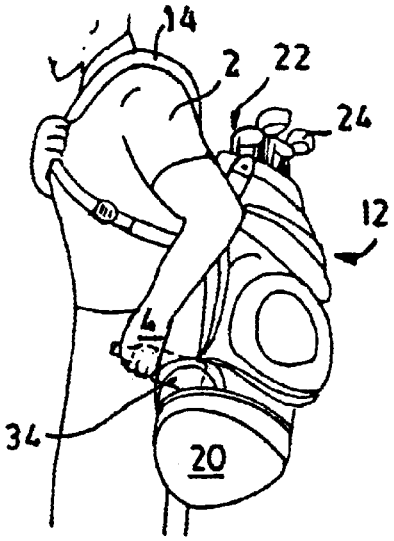
FIG. 1 is a perspective rear view of a person carrying a golf bag utilizing the present invention.
Figure 4:
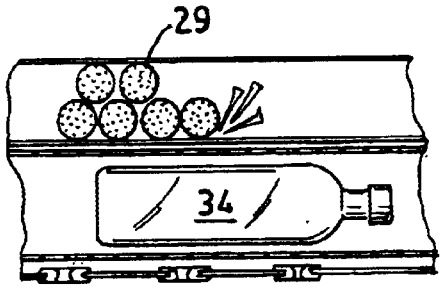
FIG. 4 is a cross sectional view of the present invention.
Figure 2:
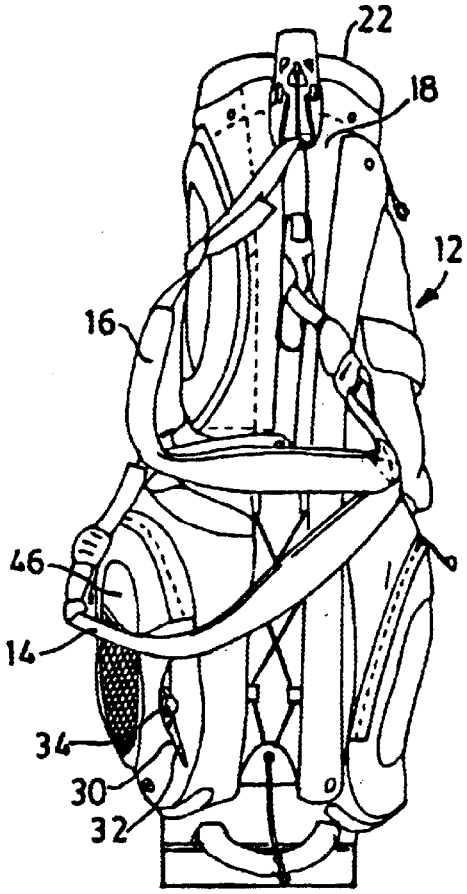
FIG. 2 is a front view in elevation of the present invention attached to a golf bag.

FIG. 1 shows the present invention on a golf bag as worn by the user 2. In FIG. 1, for illustration purposes, it is seen that a person 2 carries a golf bag 12 in a fully supported state by a first strap 14 and a second strap 16 (FIG. 2). Golf bag 12 is in the form of an elongated tubular body having a surrounding sidewall 18, a closed end 20 and an open end 22 so that set of golf clubs 24 may be inserted in golf bag 12 for storage and transport. The ball pocket 28 is provided to permit transport of auxiliary golf equipment, such as golf balls 29 (FIG. 4).

Figure 3:
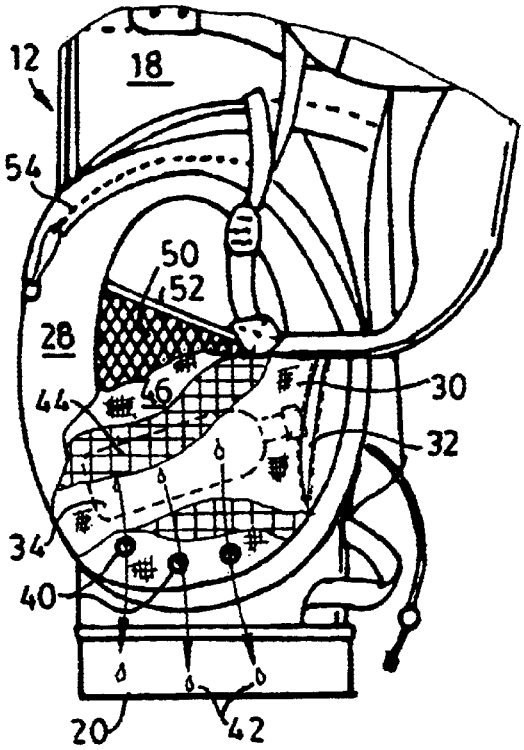
FIG. 3 is a side view of the present invention attached to a golf bag.

FIG. 2 shows the bottle pocket 30 of the present invention. The present invention allows the bottle pocket 30 to be easily accessible to the wearer when the golf bag 12 is worn across the back. The bottle pocket 30, as best seen in FIGS. 2 and 3, is attached to the ball pocket 28 by any known methods. Alternatively, the bottle pocket 30 could be attached directly to the bag 12. The bottle pocket 30 includes an opening 32 sized such that a standard sized bottle 34 can be easily inserted into and removed from the bottle pocket 30, but not so large as to allow the bottle 34 to slip out of the opening 32 when the golf bag 12 is rotated to other positions.

The bottle pocket 30 is preferably constructed as a mesh insert 44 between the ball pocket 28 and a pocket cover 46. The bottle 34 fits into this mesh insert 44 between the ball pocket 28 and the pocket cover 46. If desired, other pockets may be incorporated around the bottle pocket 30. For example, in FIG. 3, a mesh pocket 50 with a slash opening 52 is shown. A zippered opening 54 is also provided to allow access to a small pocket (not shown) adjacent the bottle pocket 30. The pocket cover 46 includes vent holes 40 designed to allow condensation or other liquid 42 to drain from the bottle pocket 30.

FIG. 1 shows the user 2 reaching for the bottle 34 with his left hand 4. As shown, the bottle pocket 30 holds the bottle 34 in a location which can be reached by the user's left hand 4 without difficulty. It will be understood that if the user 2 is left handed, the golf bag 12 would be worn in the opposite orientation (not shown) and the user 2 would reach for the bottle 34 with his right hand.

FIG. 2 shows the bottle 34 held in the bottle pocket 30 with the golf bag 12 in an upright position. The bottle 34 is held generally horizontally in this orientation, but is kept inside the pocket 30

Accordingly, the present invention has been described with some degree of particularly directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

What is claimed is:

1. In a golf bag having a longitudinal axis and two shoulder straps to be worn over the shoulders of a person such that the longitudinal axis is generally horizontal, the golf bag having a first side facing the back of the person and a second side facing away from the back of the person, the improvement comprising:

a first compartment attached to the first side of the golf bag; and a second compartment attached to the first compartment sized to receive a single bottle, wherein the bottle is oriented substantially vertically and substantially transverse to the longitudinal axis of the golf bag and the bottle is held securely in place in the vertical position.

2. The golf bag of claim 1 wherein the second compartment includes vent holes providing a liquid passageway to allow liquid to pass from the second compartment.

3. The golf bag of claim 1 wherein the second compartment is constructed from mesh material.

4. The golf bag of claim 3 wherein the mesh material is between the first compartment and an outside cover.

5. The golf bag of claim 4 wherein the outside cover has vent holes providing a liquid passageway to allow liquid to pass through the outside cover.

6. The golf bag of claim 5 wherein the outside cover includes a pocket mounted on its surface.

7. In a golf bag having a longitudinal axis and two shoulder straps to be worn over the shoulders of a person such that the longitudinal axis is generally horizontal, the golf bag having a first side facing the back of the person and a second side facing away from the back of the person the improvement comprising:

a compartment attached to the first side of the golf bag sized to receive a single bottle, wherein the bottle is oriented substantially vertically and substantially transverse to the longitudinal axis of the golf bag and the bottle is held securely in place in the vertical position.

8. The golf bag of claim 7 wherein the compartment includes vent holes providing a liquid passageway to allow liquid to pass from the compartment.

9. The golf bag of claim 7 wherein the compartment is constructed from mesh material.

10. The golf bag of claim 9 wherein the mesh material is between a second compartment and an outside cover.

11. The golf bag of claim 10 wherein the outside cover has vent holes providing a liquid passageway to allow liquid to pass through the outside cover.

12. The golf bag of claim 11 wherein the outside cover includes a pocket mounted on its surface.

* * * * *